United States Patent [19]

Donahue et al.

[11] 4,103,981

[45] Aug. 1, 1978

[54] REMOVABLE FURNITURE PANEL

[75] Inventors: Charles R. Donahue; Leo Terlecki, both of Youngstown, Ohio

[73] Assignee: GF Business Equipment, Inc., Youngstown, Ohio

[21] Appl. No.: 730,278

[22] Filed: Oct. 6, 1976

[51] Int. Cl.[2] ..... A47B 43/00

[52] U.S. Cl. ..... 312/257 A; 312/195; 108/157; 52/512

[58] Field of Search ..... 312/257 R, 257 SM, 257 A, 312/257 SK, 194–203, 111, 195; 108/90, 110, 157; 52/509, 511, 512

[56] References Cited

U.S. PATENT DOCUMENTS

| | | | |
|---|---|---|---|
| 2,205,700 | 6/1940 | Smith | 52/511 X |
| 2,498,554 | 2/1950 | Klein | 312/257 R |
| 2,609,264 | 9/1952 | Poe | 108/157 |
| 2,622,584 | 12/1952 | Reeves | 312/257 R |
| 2,653,686 | 9/1953 | Routt | 52/511 X |
| 2,866,676 | 12/1958 | Goebel | 312/257 R |
| 2,871,520 | 2/1959 | Ruda | 52/511 X |
| 3,042,473 | 7/1962 | Vincens | 312/257 R |
| 3,105,726 | 10/1963 | Jung | 312/257 A |
| 3,197,265 | 7/1965 | Rand | 312/257 R |
| 3,228,360 | 1/1966 | Jones | 108/157 |
| 3,300,078 | 1/1967 | Stanback | 312/257 R |
| 3,623,784 | 11/1971 | Neufeld | 312/257 SM |
| 3,650,586 | 3/1972 | Nightingale | 312/195 |
| 3,857,622 | 12/1974 | Mohr et al. | 312/257 |
| 3,883,196 | 5/1975 | Mohr et al. | 312/194 |
| 3,950,904 | 4/1976 | Littman | 52/512 |

FOREIGN PATENT DOCUMENTS

| | | | |
|---|---|---|---|
| 240,424 | 9/1962 | Australia | 312/257 A |

*Primary Examiner*—Paul R. Gilliam
*Assistant Examiner*—Victor N. Sakran
*Attorney, Agent, or Firm*—Emory L. Groff, Jr.

[57] ABSTRACT

An article of furniture includes a frame to which is attached a removable panel having fixed fastening means adjacent its top and bottom edge. The bottom-most fastener means are pivotally engageable with fixed brackets on the frame while the top-most fastener means are insertable through the frame and subsequently locked in an assembled position by means of a reciprocal latch member operable only from within the confines of the furniture article.

6 Claims, 8 Drawing Figures

D
2
3
8
12
35
20
42
11
19
7
13
20
17
1
4
13
5
6
9

8
10
37
4'
1
36
10
38
40
40
50
39
7
13
19
16
18
20
17
44
41
48
43
45
47
42
15
33
26
34'
24
26
28
22
21
9
27
29
31
23
32
25
30

REMOVABLE FURNITURE PANEL

This invention relates generally to furniture construction and more particularly to an improved arrangement for the attachment of a panel member intended to be removably connected to an article of furniture such as a desk.

In the construction of present day office furniture, such as single or double pedestal desks, it is often desirable to provide means whereby one or more panels enclosing the outer periphery of a pedestal of the desk may be readily removed and replaced with the expenditure of a minimum amount of time and effort. Such a feature allows for the repair or replacement of a damaged panel or the substitution of a panel having a different exterior finish without the necessity of transporting the furniture article to a distant repair facility. Additionally, means are often desired to permit the ready installation of electrical or telephonic cables and associated connectors and by providing a wiring access in a removable furniture panel it will follow that cables having oversized connectors may be easily passed through the panel by momentarily removing the panel.

The provision of removable furniture panels is well known in this art, yet many of the prior structures exhibit shortcomings which have been rectified by the present invention. Two conditions are most desirable — namely, that no tools be required to remove and install the panel and secondly, that security of the furniture article interior is maintained. By the present invention an improved arrangement is provided wherein no tools are required for the removal or attachment of a panel while at the same time the panel cannot be removed by an unauthorized person when access to a normally hidden reciprocating latch member is denied.

Accordingly, one of the primary objects of the present invention is to provide an improved removable furniture panel having clip means engageable by reciprocating latch means operable from within the interior of the furniture article.

A further object of the present invention is to provide an improved removable furniture panel including hanger means at the bottom thereof engageable with bracket means projecting from the furniture article and including a plurality of clips at the top of the panel engageable by a displaceable slide bar within the interior of the furniture article.

Still another object of the present invention is to provide an improved removable furniture panel including a plurality of clips projecting inwardly from the top of the panel insertable through openings in the furniture article frame prior to engagement thereof by a reciprocating latch member disposed on the interior of the furniture article frame.

Another object of the present invention is to provide an improved removable furniture panel including hanger members at the bottom thereof engageable with brackets at the bottom of the furniture article to retain the lower portion of the panel juxtaposed the bottom of the furniture article and including a plurality of clips at the top thereof having cam means thereon engageable by a displaceable slide bar within the confines of a drawer opening to tightly urge the top of the panel member into engagement with the furniture article.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings in which.

Similar reference characters designate corresponding parts throughout the several figures of the drawings.

Figure 1:
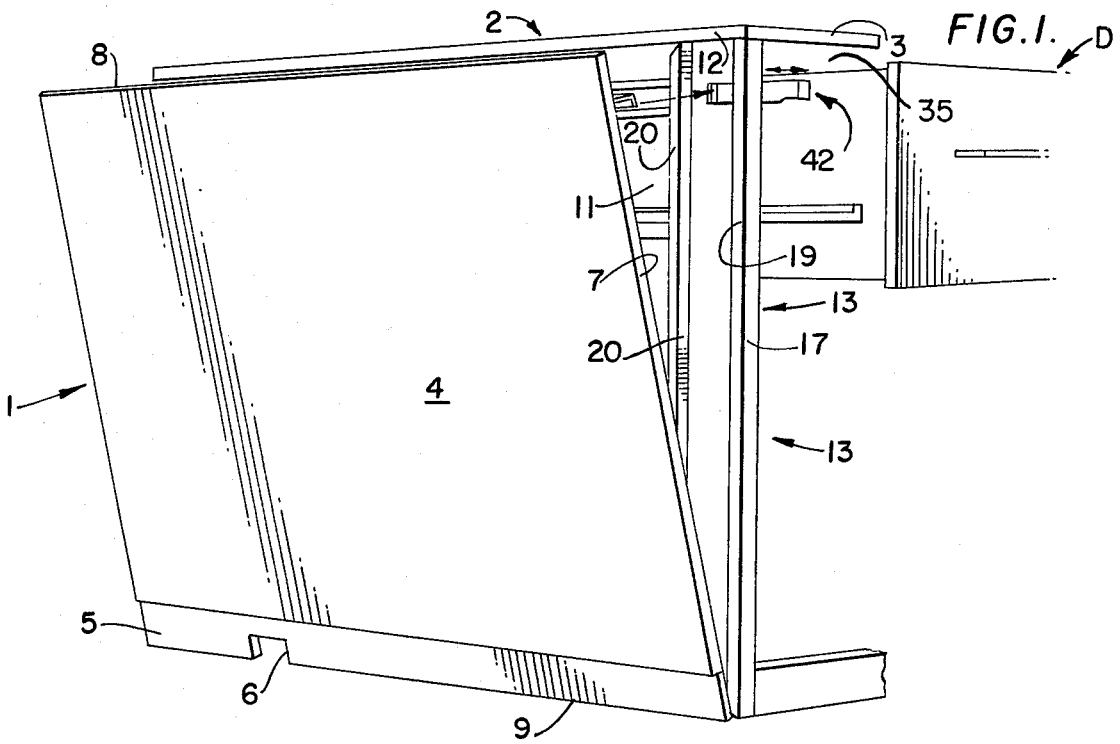
FIG. 1 is a partial perspective view and illustrates a removable furniture panel according to the present invention as it is being secured to the end of a furniture article.

Referring now to the drawings, particularly FIG. 1, the present invention will be understood to relate to a panel 1 adapted to be removably attached to a furniture article, generally designated 2, For the purpose of illustrating the attendant structure of the instant invention only a fragmentary portion of a furniture article 2 is shown since the invention may be practised in association with various types of furniture articles and the panel 1 may be either a front panel or an end panel, yet most conveniently the panel 1 is an end panel adapted to enclose a drawer-containing pedestal located below the top 3 of a furniture article such as a desk. The end panel 1 is preferably constructed to include a unitary, substantially planar exterior surface 4 and may include a recessed kick plate 5 extending horizontally along the bottom thereof which in turn is provided with a cut-out forming a wiring access 6. The exterior surface 4 of the end panel 1 is bounded by two side edges 7—7, a top edge 8 and a bottom edge 9 which in turn are joined to an inner flange 10 disposed parallel to the exterior surface 4 and which is shown most clearly in FIG. 2 of the drawings.

The panel 1 is intended to overlie and enclose the end opening 11 as formed beneath the edge 12 of the desk top 3 and between the front and rear frame uprights 13 and 14 and above the horizontal bottom frame member 15. When in the referenced vertical assembled position the inner flanges 10 of the panel will flushly engage portions of the desk frame members and be secured there-against by means of elements fixedly connected to the interior surface 4' of the panel and cooperating components carried by the desk frame members.

The two frame uprights 13 and 14 will be seen to comprise corner posts or legs disposed at opposite portions of one end of the desk top 3 and each upright includes a planar web 16 connected to opposed front and rear edges 17 and 18 respectively, which edges in turn are provided with an outer flange 19 and inner flange 20 respectively. As shown most clearly in FIGS. 4 and 5 of the drawings, the referenced outer and inner flanges 19 and 20 of the two uprights 13 and 14 are all disposed in a common plane defining the outermost structure of the end of the desk when the panel is removed. Spanning the lower portion of the two frame uprights 13–14 is the bottom frame member 15, which will be seen to include a central web 21 from which extends inwardly an upper flange 22 and lower flange 23 while the upper extremities of each of the uprights 13–14 are suitably anchored beneath the undersurface of the top 3. With the foregoing in mind it will be understood that when the end panel 1 is secured in position to enclose the desk end opening 11, the two inner flanges 10 thereof adjacent the sides 7 of the panel engage the outer flanges 19 of the front and rear frame uprights 13 and 14. Additionally, the end edge 12 of the desk top 3 may be disposed in the same vertical plane as the frame upright outer flanges 19 and inner flanges 20 such that when the panel is secured in position the inner flange 10 of the panel adjacent the panel top edge 8 will tightly engage the edge 12 of the desk top 3.

The panel 1 is attached to the furniture article 2 by initially placing the bottom edge 9 thereof juxtaposed the bottom frame member 15 with the top edge 8 of the panel inclined away from the furniture article as shown in FIG. 1 of the drawings. This initial step serves to properly orient the panel 1 relative the desk both vertically and laterally due to the provision of a plurality of hanger members, generally designated 24, fixedly carried by the lower portion of the panel and which cooperate with a similar number of retainer brackets 25 fixedly attached to the desk bottom frame member 15. As shown most clearly in FIG. 2 of the drawings, each hanger member 24 comprises a substantially U-shaped element when viewed in plan having a pair of laterally projecting mounting feet 26—26 from which extend outwardly the pair of parallel projecting arms 27—27 having their distal portions joined by means of an inner catch plate 28 disposed parallel to the panel interior surface 4'. The lower edge of each of the projecting arms 27 are notched to provide the bottom depending lip 29 on the catch plate 28.

Figure 8:
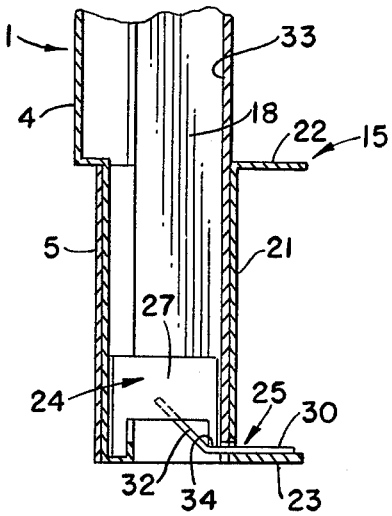
FIG. 8 is a vertical sectional view taken along the line 8—8 of FIG. 3 and illustrates the engagement of the panel mounted hanger member with the furniture article frame retainer bracket serving to secure the lower edge of the panel juxtaposed the furniture article.

The cooperating retainer brackets 25 on the desk frame each includes a mounting foot 30 suitably affixed to the bottom frame member lower flange 23 and extending through an opening 31 in the web 21 of the frame member and web 16 of the upright 13, and thence extending upwardly from the outer end of the mounting foot 30 in an angled direction to provide an inclined retainer arm 32 fully disposed within the confines of the upright edges 17 and 18. As shown most clearly in FIG. 8 of the drawings, the retainer bracket mounting foot 30 extends outwardly a small distance beyond the vertical plane of the frame upright outer face 33 so as to provide an upwardly facing horizontal seat 34 between the web outer face 33 and the beginning of the angled retainer arm 32 for reasons which will become obvious hereinafter.

Continuing with the sequence of operation associated with the attachment of the panel 1 to the desk 2, it will be understood that as the bottom edge 9 of the panel is lowered into the position illustrated in FIG. 1 of the drawings, the retainer arms 32 of each of the brackets 25 will be straddled by the catch plate 28 and projecting arms 27 of the respective hanger members 24 with the retainer arms 32 fully disposed within the arm openings 34' defined by the hanger member projecting arms 27, catch plate 28 and panel inner surface 4'. As the operator lowers the bottom edge 9 of the panel into this position the bottom depending lip 29 of the hanger member inner catch plates 28 slide upon the upper surface of the retainer bracket angled arms 32 and are urged to the bottom thereof and thence upon the seats 34 juxtaposed the outer face 33 of the frame upright webs 13. Following this initial motion, the top edge 8 of the panel is swung inwardly from the position of FIG. 1 of the drawings until the lateral inner flanges 10 of the panel are juxtaposed the outer flanges 19 of the two frame uprights 13–14, during which motion it will be understood that the depending lip 29 of the hanger members will pivot upon the seats 34 of the retainer brackets 25.

Locking means carried by the upper portion of the panel cooperate with latch means disposed within the upper portion of the drawer opening 35 on the interior of the frame uprights 13–14 when the end panel 1 is moved from the inclined position of FIG. 1 of the drawings to the vertical position flush with the end structure of the desk 2. This cooperating means include a plurality of panel clips 36 each fixedly attached to the interior surface 4' of the panel by means of a mounting foot 37. Extending inwardly in a horizontal plane from each mounting clip 37 is a projecting arm 38 having a vertically disposed lock plate 39 at its distal portion, which lock plate further includes a pair of outwardly extending tabs 40. The lateral extent of each lock plate 39 and its tabs 40 is preferably no greater than that of the connected projecting arm 38, since all of these components are intended to be passed through a clip opening 41 formed in the web 16 of the respective frame uprights 13 and 14. Accordingly, it will follow that the dimensions of each of the openings 41 are selected to permit unemcumbered passage of the lock plate 39 and projecting arm 38 as the end panel 1 is moved from the position of FIG. 1 of the drawings to the position of FIGS. 6 and 7.

Figure 2:
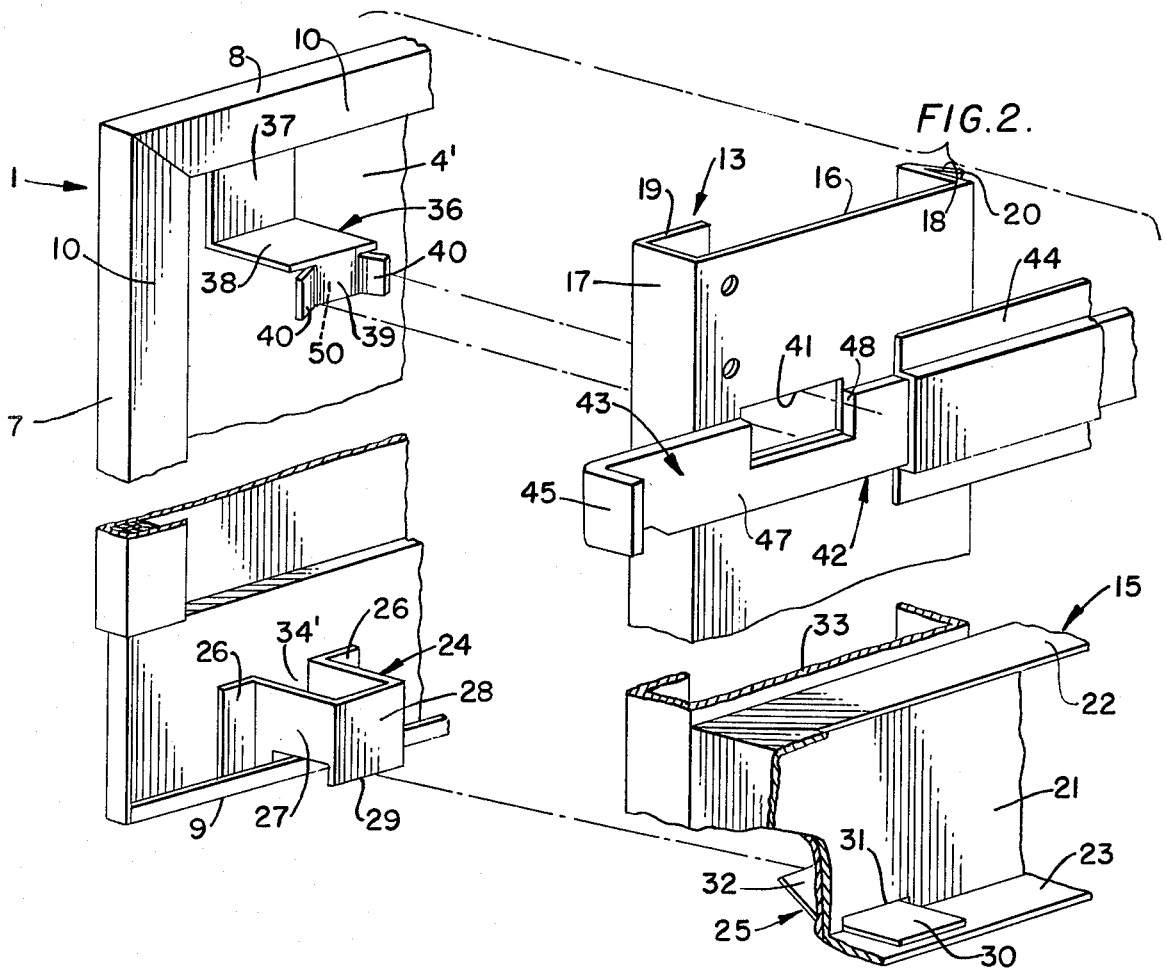
FIG. 2 is a fragmentary exploded perspective view illustrating the clip means and hanger means carried by the panel and the cooperating structure contained by the furniture article frame for securing the panel thereto, both at the top and the bottom.
Figure 3:
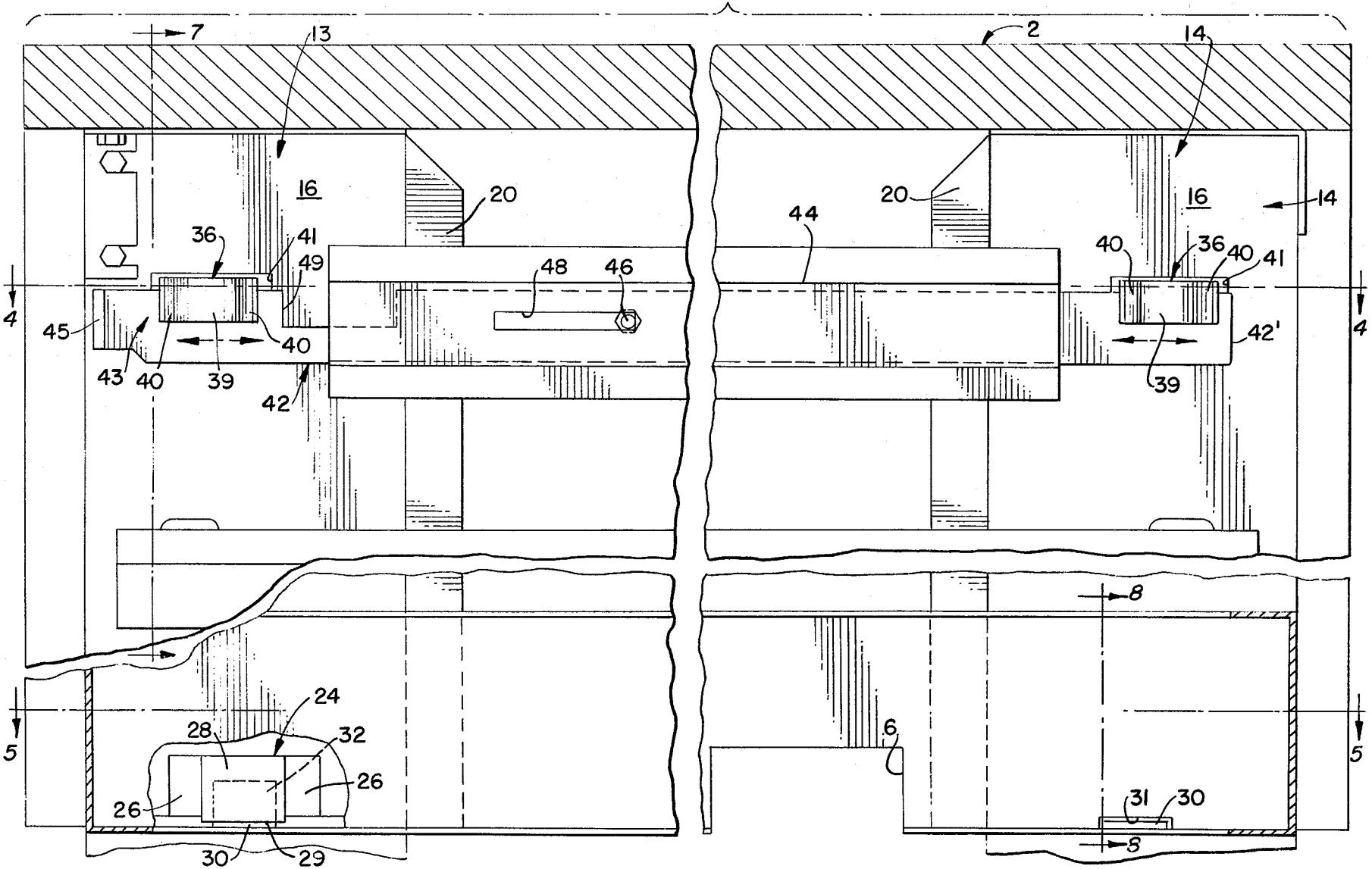
FIG. 3 is an inside elevation illustrating the retaining structure as it appears when a panel is secured to the furniture article.

A latch member, generally designated 42, is mounted within the drawer opening 35 and includes a longitudinal slide bar 43 mounted for horizontal reciprocating motion through the plane of the clip openings 41 of the two frame uprights 13 and 14. This reciprocating mounting may be readily achieved by attaching the slide bar 43 by means of a retainer channel 44 suitably affixed to the two frame uprights 13–14 as shown in FIGS. 2 and 3 of the drawings. The outer end of the slide bar 43 may be provided with an offset handle 45, the location of which is critical as will be described hereinafter.

As shown in FIG. 3 of the drawings, means are provided to limit both the forward and rearward displacement of the reciprocating latch member 42. This means include a limit pin 46 carried by the slide bar 43 and projecting from the inner face 47 of the slide bar into a horizontal slot 48 formed in the web of the retainer channel 44. As shown in this figure of the drawings, the limit pin 46 is at the rearward-most portion of the slot 48 and thus the latch member 42 is shown in its rearward-most limit of travel. When the handle 45 is pulled forwardly and the slide bar 43 is displaced to its forward-most limit of travel, a notch or catch access 49 formed in the slide bar 43 will be positioned in mating relationship adjacent the clip opening 41 in the front frame upright while the end 42' of the slide bar 43 disposed adjacent the rear upright 14 will be displaced to a position forward of the opening 41 in the rear upright 14, thus completely uncovering both of the clip openings 41.

Figure 4:
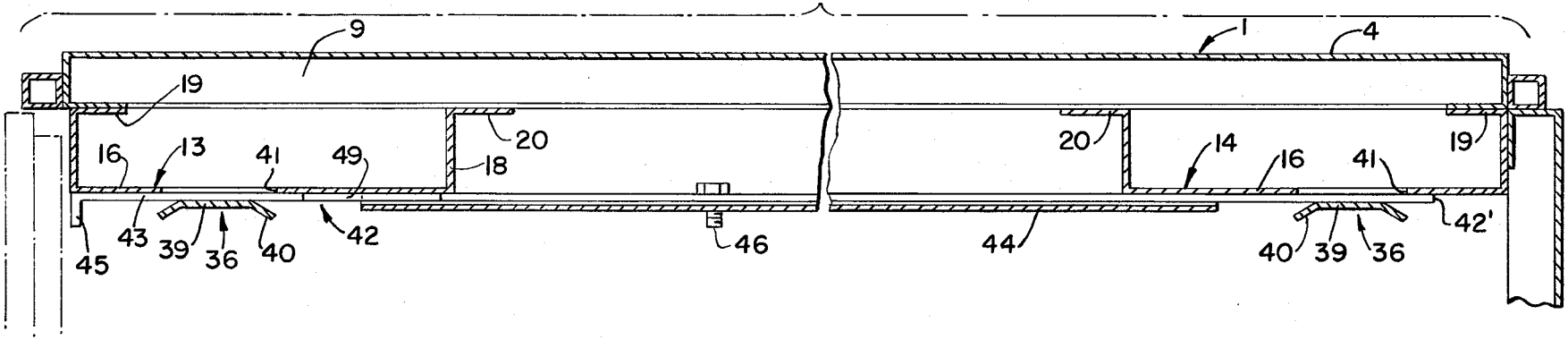
FIG. 4 is a horizontal sectional view taken along the line 4—4 of FIG. 3.
Figure 5:
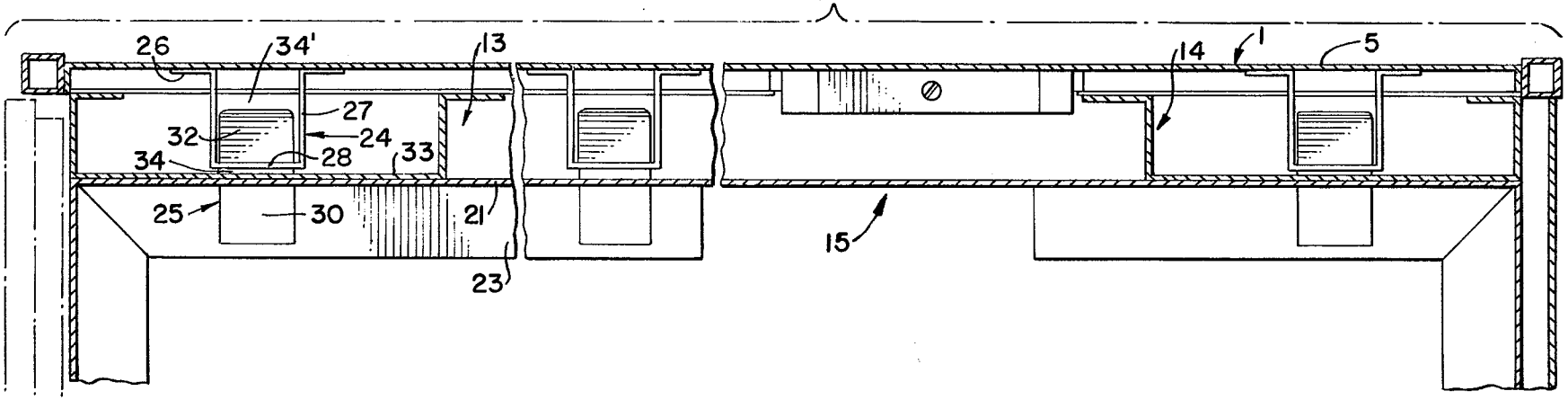
FIG. 5 is a horizontal sectional view taken along the line 5—5 of FIG. 3.
Figure 6:
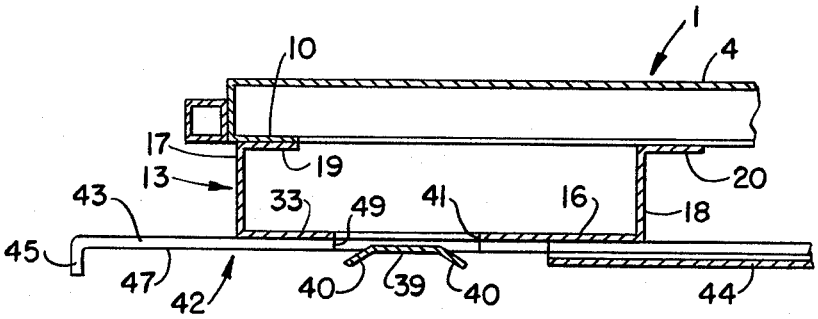
FIG. 6 is a horizontal sectional view illustrating one panel clip as it appears prior to being secured upon displacement of the latch member.
Figure 7:
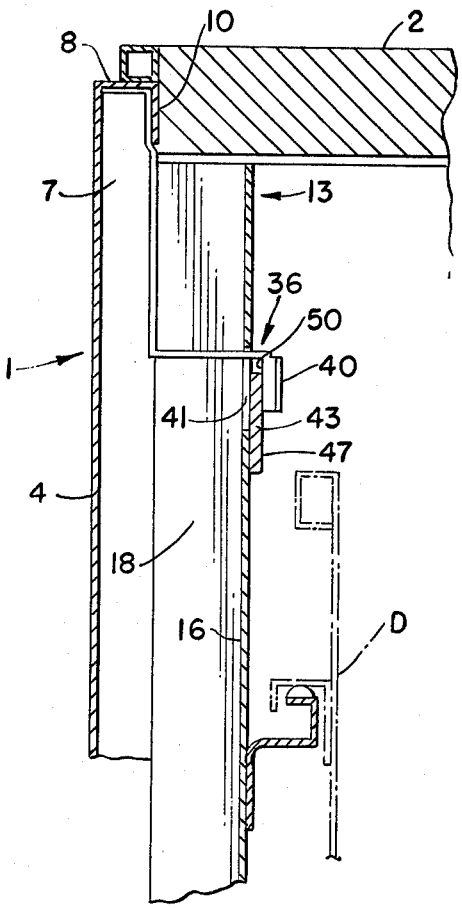
FIG. 7 is a vertical sectional view taken along the line 7—7 of FIG. 3 and illustrates the structure of FIG. 6 as it would appear after displacement of the latch member.

When the panel 1 is pushed to its full vertical position the clip 36 and its relationship with the latch member 42 will appear as shown in FIG. 6 of the drawings, which figure illustrates only the front frame upright 13 and the related clip 36 adjacent the one side edge 7 of the panel. However, it will be understood that the other panel clip 36 disposed adjacent the opposite side edge 7 of the panel will be cooperating with the rear frame upright 14 in exactly the same manner since the end 42' of the slide bar is forward of and uncovering the rear upright opening 41. Rigid attachment of the vertically disposed panel 1 is subsequently achieved by the simple rearward displacement of the slide bar handle 45 from its forward-most position as shown in FIGS. 2 and 6 of the drawings to its rearward-most position as illustrated in FIGS. 3 and 4 of the drawings. During this rearward displacement of the slide bar 43 it will be understood that the inner face 47 of the slide bar will engage the rear surface of the forward-most tab 40 of the two panel clips 36 thereby urging these panel clips inwardly with a corresponding urging of the inner flange 10 of the panel into tight engagement with the outer and inner flanges 19 and 20 of the desk frame uprights, after which the structure will appear as shown in FIG. 7 of the drawings.

From the foregoing, it will be apparent that the operation as described can only occur when access is available to the drawer opening 35 within the confines of the furniture article 2 since this access is necessary for the manipulation of the reciprocating latch member 42. This access is achieved merely by the operator pulling out the top-most drawer D in the desk pedestal, thereby exposing the handle 45 for manipulation. The previously described locking of the end panel in place may be done either by manually displacing the handle 45 inwardly or by closing the drawer D, whereupon the front D' of the drawer will automatically engage the latch member handle 45 and cause its displacement into locking position.

The removal of the end panel 1 is accomplished merely by reversing the above-described sequence of operation. Thus, it will be seen that before the end panel may be removed access must be had to the latch member handle 45 so that the slide bar 43 may be displaced outwardly to the position of FIGS. 2 and 6, thereby disengaging the two panel clip lock plates 39 at the same time that the two clip openings 41 are uncovered by the slide bar 43, so that the end panel may then be tilted from its vertical secured position to the inclined position of FIG. 1 of the drawings and thereafter the panel lifted to disengage the hanger member depending bottom lips 29 from their seats 34 formed by the retainer brackets 25.

We claim:

1. A furniture article including, a top, a frame assembly including a plurality of laterally spaced uprights engageable by said top and defining a drawer opening on the interior thereof, a vertical panel removably attached to the exterior of said frame assembly, said panel including a plurality of hanger members projecting inwardly from the lower portion of said panel, a plurality of retainer brackets extending outwardly from the lower portion of said frame assembly adapted to be engaged by said panel hanger members, a plurality of fixed clips projecting inwardly from the upper portion of said panel each including integral lock means having a rear surface spaced from said panel and disposed within the interior of said frame assembly when said panel hanger members engage said frame assembly retainer brackets and said panel is pivoted to juxtaposition said panel against the exterior of said frame assembly, at least a pair of said uprights each provided with a clip opening permitting passage of a pair of said panel clip lock means therethrough, a reciprocating latch member including a slide bar carried by at least a pair of said uprights and on the interior of said frame assembly and displaceable from an unlocked position allowing passage of said panel clip lock means into and out of the interior of said frame assembly through said upright clip openings, to a locked position whereby said slide bar engages behind said clip lock means to tightly retain said panel against the exterior of said frame assembly uprights, said slide bar having a notch therein alignable with one said clip opening when said slide bar is displaced to said unlocked position, a slidable drawer having a drawer front disposed within said drawer opening adjacent said latch member slide bar, and a handle on the forward end of said slide bar engageable by said drawer front when said slide bar is displaced to said unlocked position whereby, closing of said drawer produces engagement between said drawer front and handle and concurrent displacement of said slide bar to said locked position.

2. A furniture article according to claim 1 wherein, said panel clips include an arm projecting horizontally from said panel and said clip lock means includes a vertically disposed lock plate attached to the free end of said arm and including said rear surfaces opposed to said panel whereby, upon displacement of said slide bar to said locked position said slide bar engages said lock plate rear surfaces.

3. A furniture article according to claim 1 including, angled tabs on said clip lock plates inclined away from said panel.

4. A furniture article according to claim 1 wherein, each said hanger member includes a catch plate having a bottom lip spaced from said panel, each said retainer bracket including an upwardly inclined arm projecting from each one of said frame uprights, and a seat adjacent the lower portion of each said bracket arm and its respective frame upright whereby, said panel catch plate lips when lowered upon said retainer bracket arms are guided and pivotally retained upon said seats.

5. A furniture article according to claim 1 including, stop means carried by said slide bar limiting reciprocating displacement thereof.

6. A furniture article according to claim 5 including, a horizontal retainer channel spanning said front and rear uprights, said channel having a horizontal slot therein, said slide bar mounted within said channel, and said stop means includes a limit pin carried by said slide bar and disposed within said slot.

* * * * *